US005626027A

United States Patent [19]

Dormer et al.

[11] Patent Number: 5,626,027

[45] Date of Patent: May 6, 1997

[54] CAPACITY CONTROL FOR MULTI-STAGE COMPRESSORS

[75] Inventors: Michael J. Dormer, Fabius; Peter F. Kaido, Verona, both of N.Y.

[73] Assignee: Carrier Corporation, Syracuse, N.Y.

[21] Appl. No.: 360,483

[22] Filed: Dec. 21, 1994

[51] Int. Cl.[6] ..... F25B 7/00; G05D 23/00

[52] U.S. Cl. ..... 62/175; 236/1 EA

[58] Field of Search ..... 62/175, 510, 228.3–228.5; 236/1 EA

[56] References Cited

U.S. PATENT DOCUMENTS

| | | | |
|---|---|---|---|
| 2,319,130 | 5/1943 | Hanson | 62/228.5 X |
| 3,098,449 | 7/1963 | Hill | 417/62 X |
| 4,152,902 | 5/1979 | Lush | 236/1 EA X |
| 4,494,383 | 1/1985 | Nagatomo et al. | 62/196.2 |
| 4,938,029 | 7/1990 | Shaw | 62/117 |
| 5,016,447 | 5/1991 | Lane et al. | 62/470 |
| 5,062,274 | 11/1991 | Shaw | 62/117 |
| 5,094,085 | 3/1992 | Irino | 62/196.2 X |
| 5,425,244 | 6/1995 | Vaynberg | 62/175 |

FOREIGN PATENT DOCUMENTS

| | | | |
|---|---|---|---|
| 53-133257 | 3/1991 | Japan . | |
| 3267592 | 11/1991 | Japan | 417/62 |

*Primary Examiner*—William E. Wayne

[57] ABSTRACT

In a positive displacement compressor having a plurality of banks, operation can be multi-staged or single staged. Single stage operation can be of a single bank or plural banks in parallel. Switchover between modes of operation is under the control of a microprocessor responsive to sensed inputs. During pulldown under ambient or condenser entering air temperatures of 100° F., or more, suction modulation is used to limit the suction pressure thereby permitting a switchover to two-stage operation and the use of an economizer.

4 Claims, 2 Drawing Sheets

CAPACITY CONTROL FOR MULTI-STAGE COMPRESSORS

BACKGROUND OF THE INVENTION

Transport refrigeration can have a load requiring a temperature of −20° F. in the case of ice cream, 0° F. in the case of some frozen foods and 40° F. in the case of flowers and fresh fruit and vegetables. A trailer may also have more than one compartment with loads having different temperature requirements. Additionally, the ambient temperatures encountered may range from −20° F., or below, to 110° F., or more. Problems arise in pulling down the temperature of the cooled space when the ambient temperature is above 100° F. and/or the condenser inlet air temperature is greater than 120° F. This is primarily because units are not ordinarily designed for efficient operation at the most extreme conditions that may be possibly encountered. Typically, when faced with operating to pulldown the temperature of the cooled space at high ambient, the unit is unable to pulldown the box temperature to set point or shuts down on a safety. Pulldown would be taking place when the zone temperature is more than 5° F. above set point. Because of the wide range of ambient temperatures that can be encountered on a single trip as well as the load temperature requirements, there can be a wide range in refrigeration capacity requirements. Commonly assigned U.S. Pat. Nos. 4,938,029, 4,986,084 and 5,062,274 disclose reduced capacity operation responsive to load requirements while U.S. Pat. No. 5,016,447 discloses a two-stage compressor with interstage cooling. In reciprocating refrigeration compressors having multiple stages of compression, the intermediate pressure gas can be routed through the crankcase sump. Utilizing this approach for low temperature applications works quite well to increase the efficiency, however, in medium and high temperature applications several complications arise. Higher crankcase pressures produce a lower effective oil viscosity, increased thrust washer loads, and increased bearing loads.

SUMMARY OF THE INVENTION

U.S. Pat. No. 5,577,390 filed Nov. 14, 1994, which is hereby incorporated by reference, discloses a compressor having plural banks of cylinders which can be operated multi-stage during low temperature operation and with a single stage or plural parallel single stages for medium and high temperature operation. Switching between single stage and multi-stage operation is under the control of a microprocessor in response to the sensed interstage or crankcase sump pressure. Multi-stage operation provides increased capacity through the use of an economizer. Reduced capacity operation can be achieved by bypassing the first stage back to suction or by employing suction cutoff in the first stage.

To facilitate box pulldown at high ambients, operation of the compressor in two-stage mode, utilizing an economizer for added capacity, is desired. However, when operating in accordance with patent application No. 08/338,076, the limiting factor of high sump (midstage) pressure is encountered. To avoid the high midstage pressure, and still realize the benefits of economizer operation, the suction gas entering the compressor is throttled, or modulated, to artificially lower the suction pressure, effectively lowering midstage pressure, at the compressor. The benefit of this mode of operation, as opposed to single stage operation, is increased capacity and lower power draw, thus facilitating pulldown at high ambients without shutdown on safeties.

It is an object of this invention to limit the suction pressure entering the compressor during high ambient pulldown.

It is another object of this invention to use suction modulation to allow the compressor to shift to two-stage operation at a higher evaporating temperature than is currently permitted due to limitations in midstage pressure. These objects, and others as will become apparent hereinafter, are accomplished by the present invention.

Basically, in a compressor capable of operation in either a single or two-stage mode, pulldown at high ambient temperature is achieved by dropping suction pressure and refrigerant flow to the compressor by suction modulation whereby a shift from single stage to two-stage operation takes place followed by economizer operation to provide extra system capacity.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
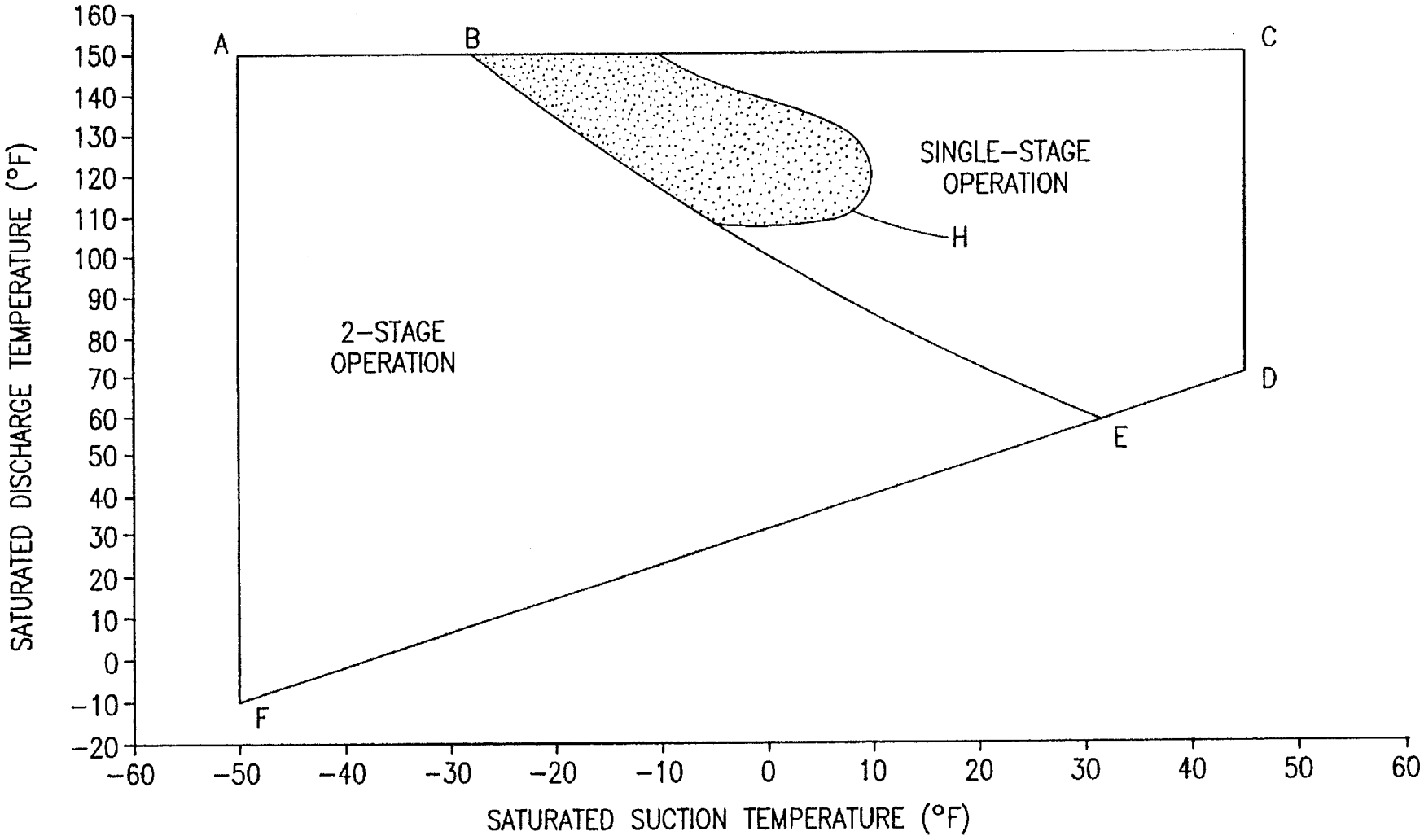
FIG. 1 is a graphical representation of a compound cooling operating envelope of a compressor operated in accordance with the teachings of the present invention.

In FIG. 1, A-B-C-D-E-F-A represents the operating envelope on a saturated discharge temperature vs. saturated suction temperature graph for a compressor employing R-22 in a compound cooling configuration. The line B-E represents the boundary between single stage and two-stage operation. The boundary is established based on sump or interstage pressure limited by thrust washer and bearing load as well as oil viscosity. Specifically, B-C-D-E-B represents the envelope where single stage operation is more effective and A-B-E-F-A represents the envelope where two-stage operation is more effective. The stippled region, H, represents the region of the operating envelope where suction modulation applied according to the teachings of the present invention can assist in pulldown.

Compressor 10 has a suction inlet 24 and a discharge 26 which are connected, respectively, to the evaporator 60 and condenser 62 of a refrigeration system. Economizer 70 and expansion device 61 are located between evaporator 60 and condenser 62. Suction inlet 24 branches into line 24-1, which, in turn branches into lines 24-3 and 24-4 which feed the cylinders of the banks of first stage 112 and line 24-2 which contains check valve 28 and connects with the crankcase 22. The first stage 112 discharges hot, high pressure refrigerant gas into line 30 which contains 3-way valve 32. Depending upon the position of 3-way valve 32, the hot high pressure gas from line 30 is supplied either to discharge 26 via line 26-1 or to the crankcase via line 34. Gas from the crankcase is drawn via line 36 into the cylinders of the second stage 114 which defines a third bank where the gas is compressed and delivered to discharge line 26 via line 26-2.

Microprocessor 50 controls the position of 3-way valve 32 through operator 33 responsive to one or more sensed conditions. Pressure sensor 40 senses the pressure in crankcase 22 which is a primary indicator of the operation of compressor 10 since midstage pressure is equal to the square root of the product of the absolute suction and discharge pressures. Microprocessor 50 receives zone information representing the set point and temperature in the zone(s) being cooled as well as other information such as the inlet and outlet temperatures and/or pressures for compressor 10, as exemplified by sensor 51, as well as ambient temperature and condenser entering air temperature.

Microprocessor 50 controls 3-way valve 32 through operator 33 to produce two-stage or single stage operation. Two-stage operation results when 3-way valve 32 connects lines 30 and 34. Line 34 leads to the crankcase 22. Gas supplied to line 24 from the evaporator 60 is supplied via lines 24-3 and 24-4 to the first stage 112 and the gas is compressed and supplied to line 30 and passes via 3-way valve 32 and line 34 into the crankcase 22. The gas in the crankcase is then drawn into the second stage 114 via line 36 and the gas is further compressed and directed via lines 26-2 and 26 to the condenser. Flow of second or high stage discharge gas is prevented from entering the crankcase 22 via line 26-1 by 3-way valve 32 and flow of suction gas into the crankcase 22 via line 24-2 is prevented by the back pressure in the crankcase 22 acting on check valve 28.

Parallel single stage operation results when 3-way valve 32 connects lines 30 and 26-1. Gas supplied to line 24 from the evaporator 60 is supplied via lines 24-3 and 24-4 to the first stage 112 and the gas is compressed and supplied to line 30 and passes via 3-way valve 32, line 26-1 and line 26 to the condenser 62. Gas in the crankcase 22 is at suction pressure so that gas is able to flow from line 24, through line 24-2 and check valve 28 into the crankcase 22. Gas from the crankcase 22 is drawn into the second stage 114, compressed and discharged via line 26-2 into common discharge 26.

Once compressor 10 is in operation, the microprocessor 50 will cause 3-way valve 32 to switch between two-stage and parallel single stage operation essentially in accordance with the appropriate operating envelope, as exemplified in FIG. 1. Specifically, the pressure sensed by pressure sensor 40 is compared to a fixed value to determine whether two-stage or single stage operation is appropriate and 3-way valve 32 is appropriately positioned.

Figure 2:
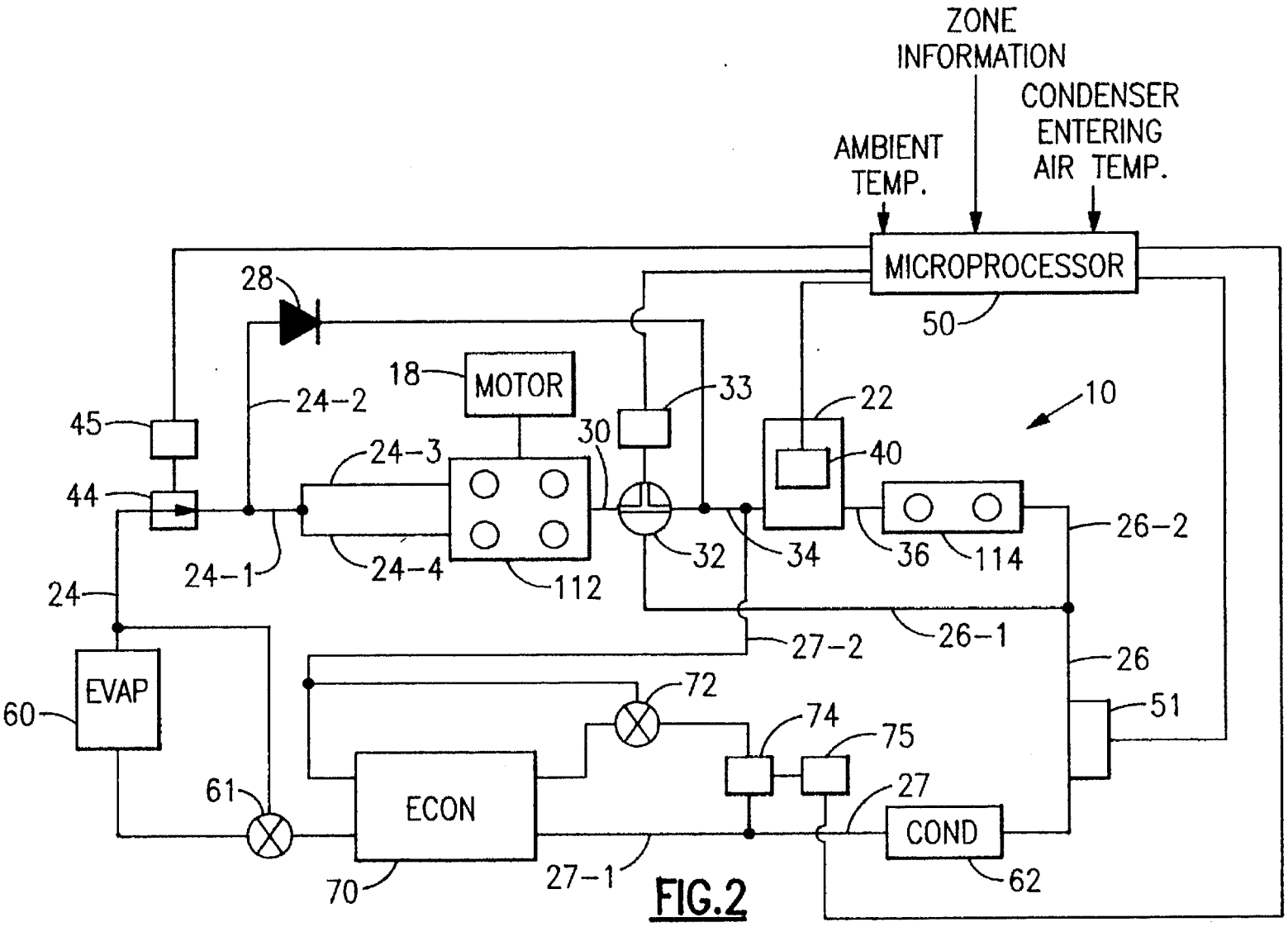
FIG. 2 is a schematic representation of a refrigeration system employing the compressor of the present invention employing suction modulation.

FIG. 2 illustrates the use of suction modulation for capacity control. Suction line 24-1 divides into lines 24-3 and 24-4 which respectively feed the two banks of first or low stage 112. Line 24-1 contains infinitely variable solenoid valve 44 having coil 45. Valve 44 functions as a suction modulating valve. When capacity control is needed, as sensed by microprocessor 50 through the zone information, coil 45 is actuated by microprocessor 50 causing valve 44 to close thereby reducing the mass flow of refrigerant entering line 24-1 from evaporator 60 and reducing compressor capacity. This approach allows greater capacity control because the mass flow of refrigerant entering line 24-1 can be reduced in small increments when the compressor 10 is operating in either the single or two-stage mode.

As is conventional, economizer 70 is located between condenser 62 and expansion device 61. Basically, economizer 70 is a heat exchanger with flow in line 27 from the condenser 62 being divided into two paths 27-1 and 27-2, respectively. The first path is for liquid refrigerant which passes from condenser 62 via lines 27 and 27-1 through economizer 70 where it is further cooled thus increasing system capacity. The second path is for liquid refrigerant which passes from condenser 62 via lines 27 and 27-2 where it is expanded by expansion device 72 causing further cooling of the liquid refrigerant passing through economizer 70 via line 27-1 with the gaseous refrigerant exiting economizer 70 via line 27-2 being supplied to line 34 of compressor 10.

Economizer operation is only suitable for two-stage operation. Accordingly, economizer operation is only possible when microprocessor 50 causes operator 75 to open normally closed valve 74. As discussed above, the present invention addresses the problem of pulldown of the cooled space when it is above set point. Limiting factors include: maximum engine power output which can be addressed by unloading the compressor, engine coolant temperature, system head pressure and compressor discharge pressure and temperature. Typically, when faced with operating in the region H of FIG. 1, prior art units would be unable to pulldown the box temperature or would shut down on a safety. If the zone set point is in the low temperature range, microprocessor 50 will try to shift compressor 10 to the two-stage operation as soon as possible on pulldown. In normal operation of the compressor 10 shifting from single stage to two-stage operation during pulldown with high ambient temperature is limited by the midstage or crankcase pressure which is sensed by sensor 40. By controlling valve 44 during pulldown at high ambient temperature, the suction pressure at compressor 10 can be effectively reduced as will power draw from the engine and the discharge temperature and pressure from compressor 10 due to less gas being compressed which results in a lower crankcase pressure sensed by sensor 40. With the resulting lower crankcase pressure, compressor 10 will shift to two-stage operation responsive to the zone set point. Once compressor 10 has shifted to two-stage operation, zone demand will still be unsatisfied so that extra system capacity can then be achieved by introducing economizer 70 into the system to give what is analogous to the turbo boost on a car engine. Economizer operation will be initiated by microprocessor 50 actuating actuator 75 to open valve 74.

Once economizer operation is initiated during pulldown, the flow via line 27-1 and economizer 70 is subcooled substantially via the flow through line 27-2, expansion device 72 and economizer 70. The subcooling provided to the flow in line 27-1 substantially increases cooling capacity in evaporator 60 and more than compensates for the loss of potential cooling capacity in the flow that is diverted into line 27-2 and injected midstage, or into line 34, of compressor 10. The extra cooling capacity of the subcooled liquid in line 27-1 allows the temperature of the cooled space to be reduced more quickly than if the compressor 10 were operating in the single stage mode. In response to zone demand, microprocessor 50 will continually try to open modulation valve 44 within the limits of unit safeties, thus increasing flow to compressor 10 results in increased system cooling capacity. Except for the switchover to two-stage operation during pulldown at high ambient, the use of an economizer, and the use of an infinitely variable solenoid for capacity control the present invention would operate the same as that described in U.S. Pat. No. 5,577,390.

Microprocessor 50 is connected to a plurality of sensors and receives inputs representing the sensed ambient temperature, condenser entering air temperature, zone temperature, and zone set point. Microprocessor 50 is also connected to crankcase pressure sensor 40 and sensor 51 which is exemplary of a plurality of sensors for sensing the inlet and outlet temperatures and/or pressures for compressor 10. Microprocessor 50 compares the sensed zone temperature and zone set point and, if the sensed ambient or condenser entering air temperature is on the order of 100° F., or above, the sensed zone temperature exceeds the zone set point by 5° F., or more, and the first, second and third banks of compressor 10 are in single stage operation, microprocessor causes the performing of the serial steps of: reducing the capacity of the first stage 112 which defines the first and second banks and thereby the second stage 114 which defines the third bank to reduce crankcase pressure; switching over from single stage to two-stage operation of compressor 10; and, enabling economizer 70 whereby capacity is increased and the pulldown is speeded up.

Although a preferred embodiment of the present invention has been illustrated and described, other modifications will occur to those skilled in the art. It is therefore intended that the present invention is to be limited only by the scope of the appended claims.

What is claimed is:

1. In a refrigeration means under microprocessor control for cooling a zone including a closed circuit serially including compressor means, condenser means, economizer means connected to said compressor means, expansion means and evaporator means, a method for operating the refrigeration means during pulldown at high ambient temperature where the compressor means has three banks, a crankcase, a suction inlet connected to the evaporator, means for controlling mass flow to the three banks, and a discharge connected to the condenser comprising the steps of:

supplying gas from the suction inlet to the first and second banks;

supplying gas from the crankcase to a third bank of the three banks;

delivering compressed gas from the third bank to the discharge;

selectively connecting the first and second banks to either the crankcase or the discharge whereby when said first and second banks are connected to the crankcase they act as a first stage and the third bank acts as a second stage and when the first and second banks are connected to discharge they act as a single stage and the third bank acts as a single stage in parallel with the first and second banks;

sensing at least one of ambient and condenser entering air temperature;

sensing zone temperature;

sensing zone set point;

comparing zone temperature and zone set point and if the sensed ambient or condenser entering air temperature is on the order of 100° F., or above, the sensed zone temperature exceeds the zone set point by 5° F., or more, and the first, second and third banks are in single stage operation, performing the serial steps of:

reducing the capacity of said first and second banks to reduce crankcase pressure;

switching over from single stage to two-stage operation;

enabling the economizer whereby capacity is increased and the pulldown is speeded up.

2. The method of claim 1 further including the step of:

increasing the capacity of the first and second banks after the economizer is enabled.

3. The method of claim 1 wherein the step of reducing capacity of the first and second banks is achieved by suction modulation.

4. The method of claim 1 further including the steps of:

sensing pressure in the crankcase; and using the sensed pressure for controlling said step of selectively connecting the first and second banks to the crankcase discharge.

* * * * *